US005441143A

United States Patent [19]

Hösel

[11] Patent Number: 5,441,143

[45] Date of Patent: Aug. 15, 1995

[54] METHOD AND APPARATUS FOR ARRANGING FIBER BALES IN A SINGLE ROW IN PREPARATION FOR A FIBER TUFT DETACHING OPERATION

[75] Inventor: Fritz Hösel, Mönchengladbach, Germany

[73] Assignee: Trützschler GmbH & Co. KG, Mönchengladbach, Germany

[21] Appl. No.: 262,633

[22] Filed: Jun. 20, 1994

[30] Foreign Application Priority Data

Jun. 19, 1993 [DE] Germany ..... 43 20 403.1

[51] Int. Cl.[6] ..... B65G 43/08

[52] U.S. Cl. ..... 198/464.3; 198/502.2; 198/502.3; 198/572; 198/575; 19/80 R

[58] Field of Search ..... 198/434, 444, 464.2, 198/464.3, 502.2, 502.3, 572, 575; 414/412, 798.2, 799; 19/80 R

[56] References Cited

U.S. PATENT DOCUMENTS

| | | | |
|---|---|---|---|
| 3,817,368 | 6/1974 | Wentz et al. | 198/572 |
| 4,634,328 | 1/1987 | Carrell | 198/444 |
| 5,322,226 | 6/1994 | Kranefeld | 19/80 R |
| 5,328,016 | 7/1994 | Leifeld et al. | 198/434 |
| 5,335,777 | 8/1994 | Murphy et al. | 198/502.3 |
| 5,359,753 | 11/1994 | Leifeld et al. | 19/80 R |

FOREIGN PATENT DOCUMENTS

| | | |
|---|---|---|
| 4024307 | 2/1992 | Germany . |
| 4213718 | 3/1993 | Germany . |
| 4214933 | 5/1993 | Germany . |
| 1191458 | 5/1970 | United Kingdom . |
| 1269909 | 4/1972 | United Kingdom . |
| 1286805 | 8/1972 | United Kingdom . |
| 1491525 | 11/1977 | United Kingdom . |
| 2042214 | 9/1980 | United Kingdom . |
| 2227217 | 7/1990 | United Kingdom . |

*Primary Examiner*—Joseph E. Valenza
*Attorney, Agent, or Firm*—Spencer, Frank & Schneider

[57] ABSTRACT

An apparatus for arranging fiber bales to form a first, operational bale row in preparation for detaching fiber tufts by a bale opener. The apparatus has a conveying device for receiving fiber bales thereon in a second, standby row; a transporting device for consecutively carrying fiber bales along the conveying device for forming the second row thereon such that a width of the fiber bales on the conveying device extends parallel to the advancing direction; a transfer device for separating a momentarily leading fiber bale of the second row at the output end of the conveying device from the fiber bales remaining thereon and for transferring the separated fiber bale to a location receiving the fiber bales of the first bale row; a device for determining the width and ranking of each fiber bale while on the transporting device or the conveying device; a device for generating signals representing the width and ranking; a memory for storing the signals; and a device for determining, based on the signals, the extent of feed for each bale from the conveying device to the transfer device.

21 Claims, 9 Drawing Sheets

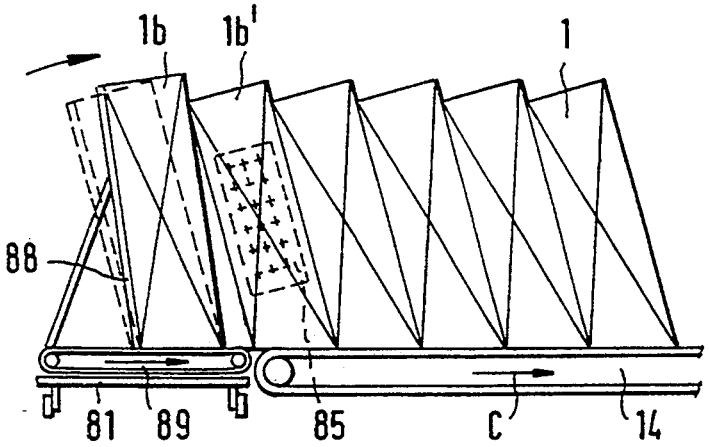
FIG. 5a
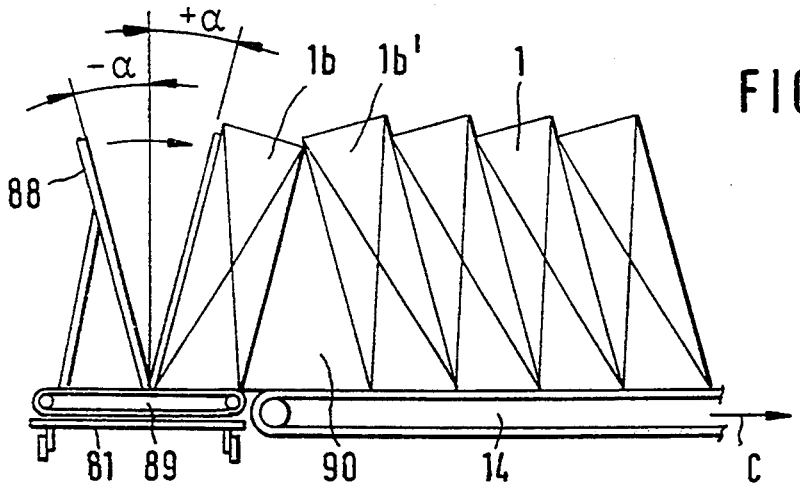
FIG. 5b
FIG. 5c
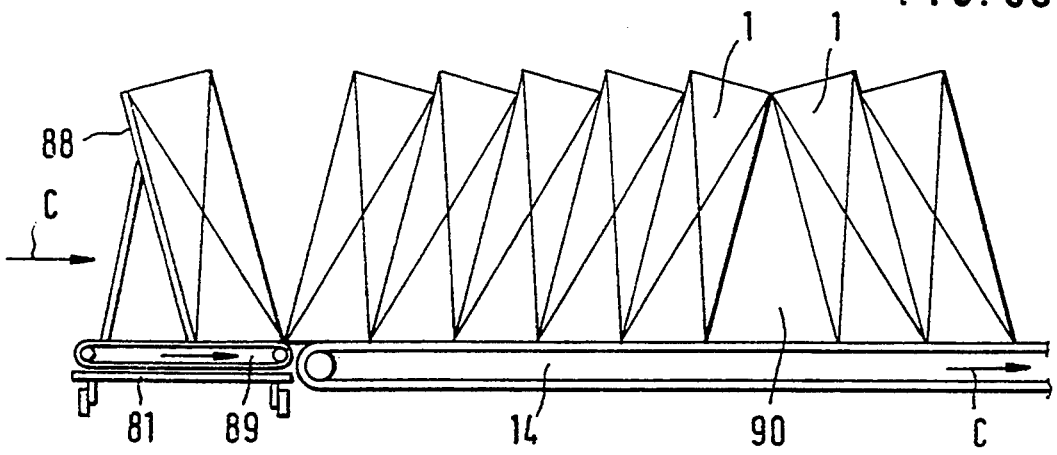

METHOD AND APPARATUS FOR ARRANGING FIBER BALES IN A SINGLE ROW IN PREPARATION FOR A FIBER TUFT DETACHING OPERATION

CROSS REFERENCE TO RELATED APPLICATION

This application claims the priority of German Application No. P 43 20 403.1 filed Jun. 19, 1993, which is incorporated herein by reference.

BACKGROUND OF THE INVENTION

This invention relates to a method of and an apparatus for readying fiber bales for a tuft removal operation by a bale opener. The fiber bales which may be composed of cotton fiber, chemical fiber, or the like are advanced to a conveying device, for example, a conveyor belt or the like; the bales are gathered into a standby row on the conveying device and thereafter the bales of the standby row are advanced into a position in the operational zone of a fiber bale opener. For this purpose, each fiber bale is loaded on a transporting device (transporting vehicle) which moves the fiber bale to the trailing end of the standby row on the conveying device and deposits the fiber bale at the trailing end of the standby row. A holding and supporting device holds and supports the initial fiber bale. The momentarily leading bale situated on the conveying device is separated from the other bales remaining on the conveying device and is transferred from the conveying device to another location, that is, to the operational zone of the bale opener.

Fiber bales have different widths, particularly if they have different origins. Since they are advanced in a direction parallel to their narrow side faces, that is, parallel to their width, it is essential that the bale to be transferred arrive into the transfer station in its entire width and that it no longer contacts the fiber bales which remain on the conveying device.

SUMMARY OF THE INVENTION

It is accordingly an object of the invention to provide an improved method and apparatus of the above-outlined type in which the support of the initial fiber bale or fiber bales as well an automatic readying of a fiber bale row is achieved in a simple and operationally reliable manner.

This object and others to become apparent as the specification progresses, are accomplished by the invention, according to which, briefly stated, the width of each bale and its ranking on the conveying device is determined; the signals representing such values are stored in a memory and are utilized in the determination of the amount (extent) of feed for the respective bales during the separation thereof from the other bales.

By determining the width of each bale in conjunction with its assigned position (ranking) on the conveying device, it is feasible to call the corresponding data from the memory when the respective bale has reached the transfer station and is about to be separated from the other bales.

According to an advantageous embodiment of the invention, the bale width is determined by a displacement (path) sensor, preferably including an optical assembly, such as optical barriers, laser beams and the like. The ranking of a bale may be expediently determined by a counter assembly with which, in a simplest version, the bales deposited on the conveying device are counted and each bale is assigned the next higher number, together with the determined width and these data are stored in the memory. During this procedure, to the extent necessary, the data are digitalized and inputted into a computer which, in accordance with a further advantageous feature of the invention, applies the feed value to a control of the conveying device and to a control of the transferring device for separating the respective bale from the bales that remain on the conveying device. Both controls are expediently connected to a stepping motor so that the conveyance of the fiber bales is effected in several cycles (cadences).

Expediently, the magnitude of feed of the transferring device is greater by a settable amount than the feed of the conveying device. Stated differently, the transferring device advances the fiber bale by at least one cycle farther than the conveying device, whereby it is ensured that a distance exists between the separated bale and the bales remaining on the conveying device.

Advantageously the bale width and also the ranking of the bales is determined upon charging the conveying device. It is particularly preferred to determine the bale width on a charging carriage.

In accordance with a further feature of the invention, an initial and a final pulse for determining the bale width is applied to the computer by means of a travelling optical barrier mounted on the conveying device. In accordance with a further advantageous feature of the invention, the initial pulse is derived from the trailing side of the bale last deposited at the standby row whereas the final pulse is derived after depositing a further bale on the conveying device and after displacing the optical barrier to the trailing side of the last-mentioned bale. As an initial impulse pertaining to a newly deposited bale preferably the terminal pulse of the previously deposited bale is utilized.

The charging carriage associated with the conveying device is charged in a conventional manner by a storage system vehicle such as a forklift which places a single bale on the charging carriage and presses the bale against an abutment arranged in the forward (leading) zone of the charging carriage. Such an abutment which may be constituted by a gate installed on the loading carriage, expediently forms the zero point for the width measurement. A corresponding signal may then be generated by a pressure sensor connected with the abutment gate. Thereafter, the charging carriage travels to the bale conveying device and, by pushing the bale from the charging carriage, deposits the same on the conveying device. The shifting (pushing) of the bale is carried out by the abutment gate which, after having been moved in a withdrawn position past the bale, arrives at the trailing side thereof and after the gate is extended, that is, placed in an operative position, it pushes the bale off the charging carriage and onto the conveying device. The path through which the abutment gate travels as it pushes the bale off the charging carriage exactly corresponds to the bale width. Therefore, such a displacement path is detected by a displacement sensor and stored for the feed for the bale at the transfer and separating stations.

The apparatus according to the invention includes a computer connected with a displacement sensor and a counter as well as control devices for the bale conveying device and the bale transfer device. The displacement sensor preferably includes a counter associated with a proximity switch. Expediently, the displacement sensor is an incremental rotary position detector. Preferably, the optical sensor includes at least one optical barrier arranged displaceably on the conveying device. The optical sensor preferably has a light-emitting diode row and an associated photodiode row. One of the diode rows is expediently stationarily mounted on the charging carriage whereas the other diode row is coupled with the support for the travelling abutment gate which serves for displacing the respective bale on the charging carriage. By virtue of this arrangement according to the invention, dependent upon the position of the abutment, more or less light-emitting diodes of the light diode row face a corresponding number of diodes of the photodiode row so that the generated signals (voltages or currents) may represent the width of the respective fiber bale.

BRIEF DESCRIPTION OF THE DRAWINGS

FIGS. 5*a*, 5*b* and 5*c* are schematic side elevational views of the bale transfer station of the construction shown in FIG. 1, illustrating three different operational positions.

DESCRIPTION OF THE PREFERRED EMBODIMENTS

Figure 1:
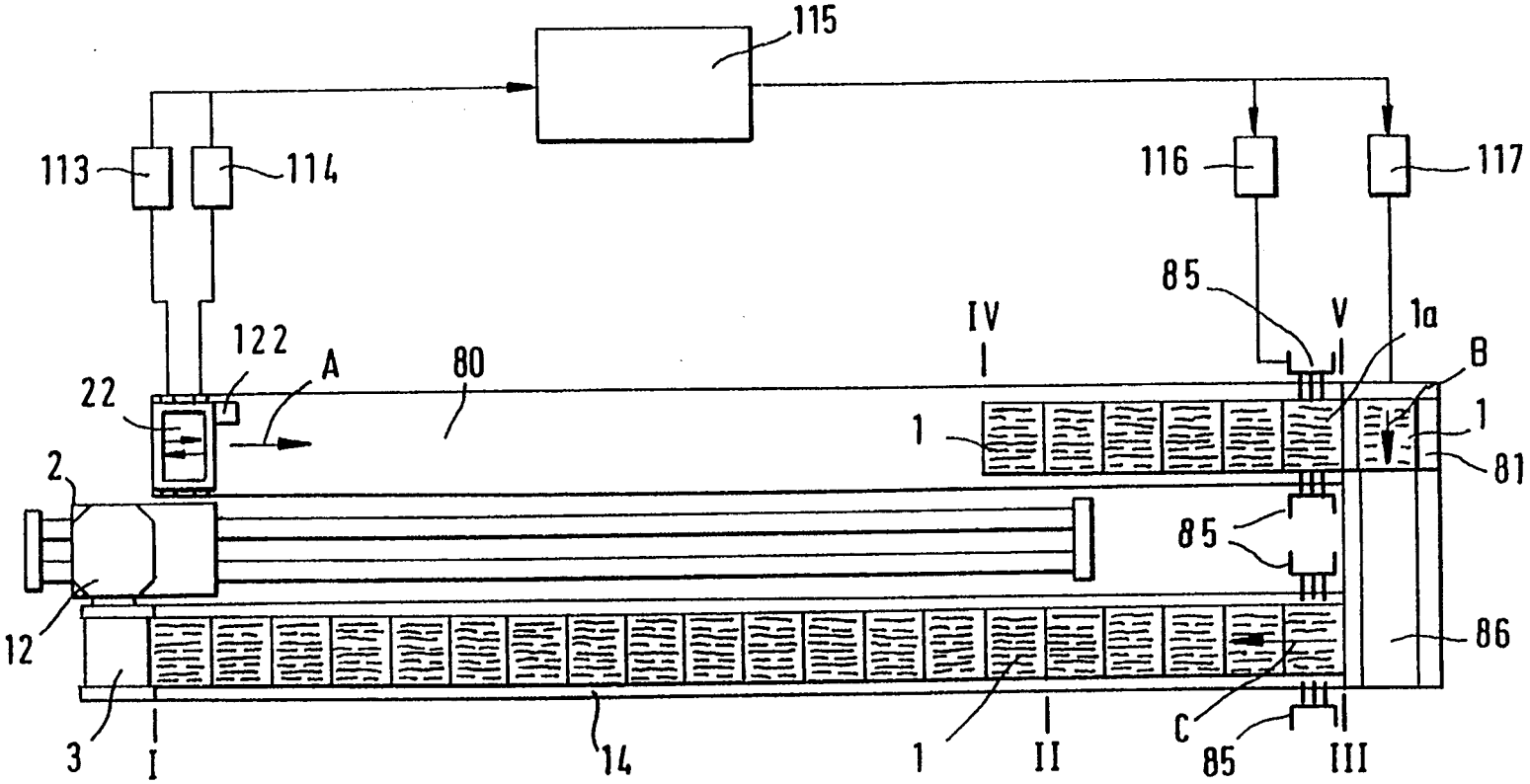
FIG. 1 is a schematic top plan view of a travelling bale opener, a bale conveying device, a transfer region, a standby region and a working region.

Turning to FIG. 1, there is shown a bale charging (bale transporting) carriage 22 situated at the input end of a conveying device (belt conveyor) 80 which is moved in the direction of the arrow A. The charging carriage 22 is ready to receive a fiber bale 1 (for example, from a forklift) and transport the same to the end of a row (standby row) of fiber bales 1 lined up on the conveying device 80. The initial fiber bale 1*a*, that is, the bale closest to the right hand side output end of the conveying device 80 is held by means of bilaterally arranged spiked boards 85 penetrating into the opposite lateral end faces of the bale. A transfer carriage 81 which is still in the charging position in alignment with the output end of the conveying device 80 has already received a fiber bale 1 and is ready to transport the fiber bale, while travelling on rails 86, to the unloading (transfer) location at the input end of a conveyor belt 14. Since the conveyor belt 14 is essentially fully occupied by serially arranged bales 1, the holding device (spiked boards) 85 at the input end of the conveyor belt 14 is in its withdrawn, inoperative position, that is, in a state in which it does not engage any fiber bales.

Figure 2:
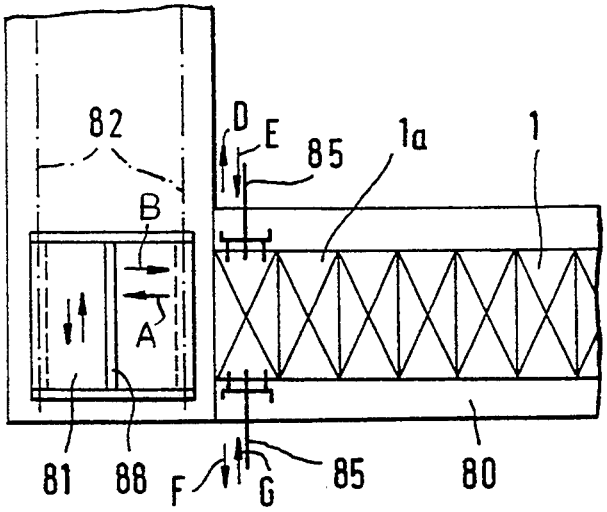
FIG. 2 is an enlarged schematic top plan view of the bale separating region of the construction shown in FIG. 1.
Figure 3:
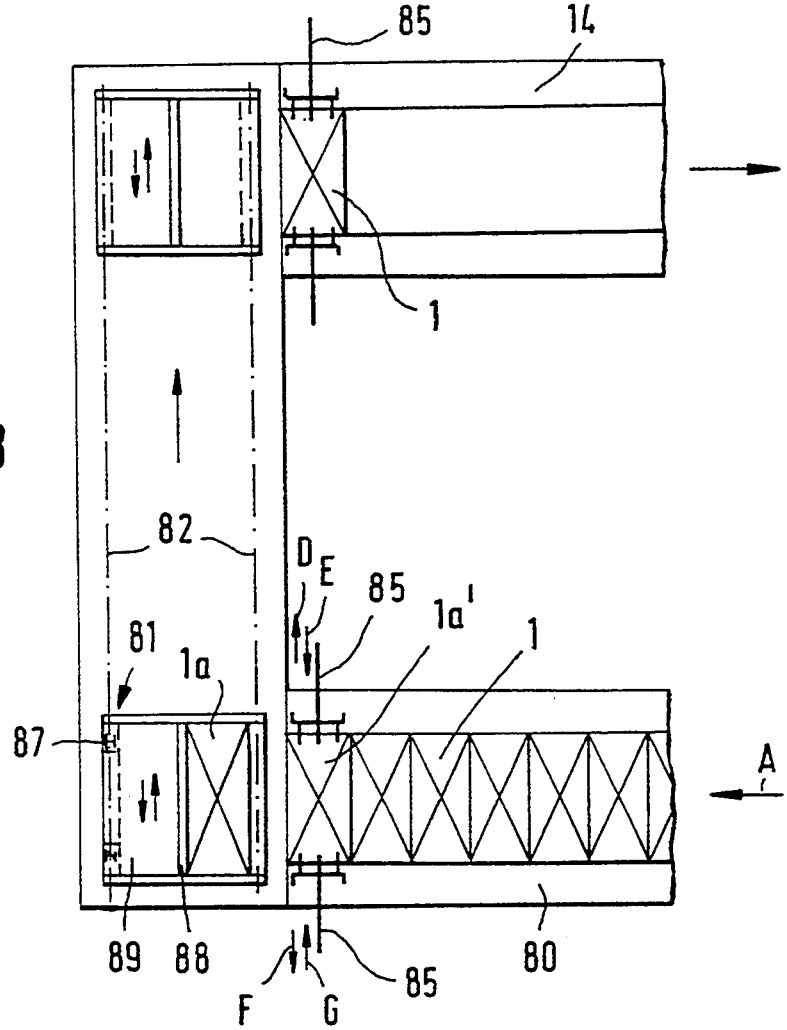
FIG. 3 is an enlarged schematic top plan view of the bale separating and transfer region.

Turning to FIG. 2, there is illustrated therein the region for separating the fiber bales 1 from the bale row positioned on the conveyor 80. The initial fiber bale 1*a* is held by the spiked boards 85. The support wall 88 of the transfer carriage 81 is displaced toward the initial bale 1*a* in the direction of the arrow B and then engages and supports the same. Thereafter the spiked boards 85 are withdrawn, whereupon the conveying device 80 as well as the transfer belt 89 mounted on the transfer carriage 81 are set into motion, whereby the initial bale 1*a* and supporting wall 88 travel in the direction of the arrow A. The second bale 1*a*′ thus reaches the end position on the conveying device 80 as illustrated in FIG. 3. The feed motion of the conveying device 80 is discontinued and the spiked boards 85 are moved into the side faces of the fiber bale 1*a*′. The fiber bale 1*a* on the transfer carriage 81 is moved by the converting belt 89 in the direction of the arrow A until the bale 1*a*′ is separated from the bales still situated on the conveying device 80. Then the transfer carriage 81 may move on the rails 82 into its second position which is the discharging position in alignment with the input end of the conveyor belt 14. Along the conveyor belt 14 on which a bale row (operational row) is set up in a manner described below, a bale opener 12 travels back and forth for detaching fiber tufts from the top of the bales on conveyor belt 14. The bale opener 12 which has a carriage 2 and a detaching device 3, may be, for example, a BLENDOMAT BDT 020 model, manufactured by Trützschler GmbH and Co. KG of Mönchengladbach, Germany.

In the operational phase depicted in FIG. 3, a single bale 1 is positioned on the conveyor belt 14 which means that charging the conveyor belt 14 with bales has just been started. The single fiber bale 1 on the conveyor belt 14 is held in position by the spiked boards 85 and is, as it will be described later in further detail, inclined in the direction of the transfer carriage 81.

Figure 4A:
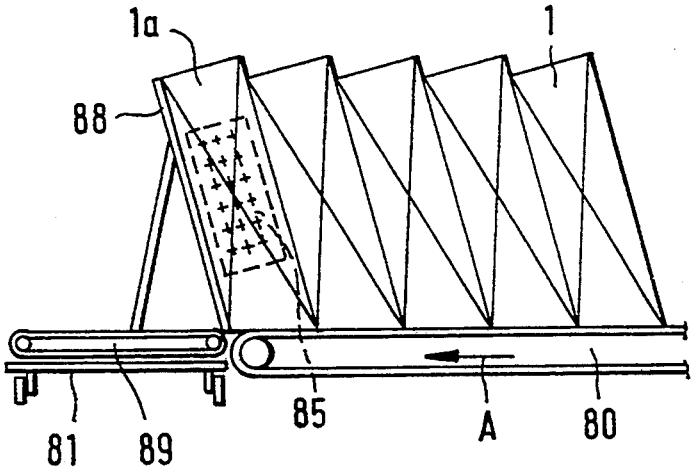
FIGS. 4*a* and 4*b* are schematic side elevational views of the bale separating station of the FIG. 1 construction, showing two different operational positions.
Figure 4B:
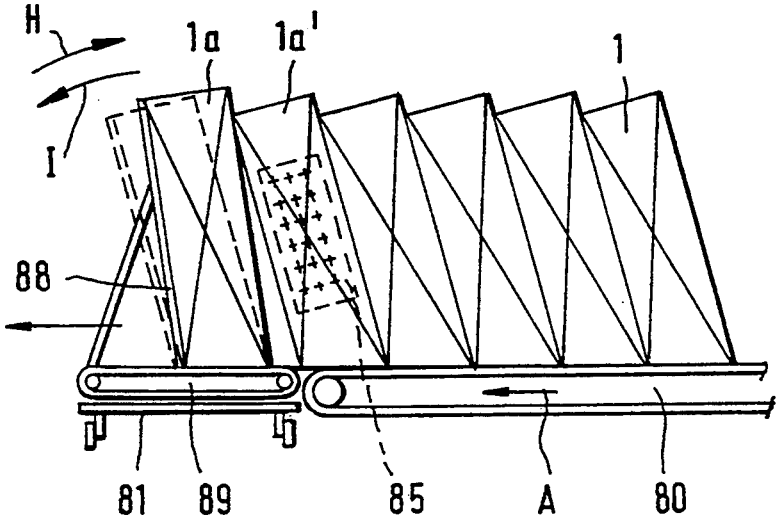

FIGS. 4*a* and 4*b* illustrate the separation of the bales 1. On the conveying device 80, a plurality of bales 1, set up in an inclined orientation, is moved in the direction of arrow A. The leading bale 1*a* is held in position by the spiked boards 85 penetrating into opposite side faces of the bale. The transfer carriage 81 is in its bale-receiving position in alignment with the conveying device 80. The supporting wall 88 of the transfer carriage 81 is extended and lies against the leading face of the initial fiber bale 1*a*. In this position the spiked boards 85 may be withdrawn in the direction of arrows D and F so that the fiber bale 1*a* is laterally free and is held only by the supporting wall 88 of the transfer carriage 81. After the withdrawal of the spiked boards 85, the feed motion of the transfer belt 89 and the conveying device 80 simultaneously start, whereby a bale transport by one step, that is, by one bale width as viewed in the direction of bale advance is performed. As a result, the earlier second bale 1 assumes its position at the output end of the conveyor 80 as the new initial bale 1*a*′. The spiked boards 85 are again activated (that is, moved in the direction of the arrows E and G) and laterally penetrate into opposite sides of the bale 1*a*′. The transfer belt 89 continues to displace the initial bale 1*a* in the direction A until a free space is obtained between the bales 1*a* and 1*a*′. Thereafter, the inclination of the supporting wall 88, that is, the angle $\alpha$ is set for the travel of the transfer carriage 81 on the rails 82 as indicated by arrows H, I.

FIGS. 5*a*, 5b, and 5*c* illustrate the positioning of the fiber bales 1 on the conveyor belt 14. After the transfer carriage 81 has travelled to its end position in alignment with the input end of the conveyor belt 14 on which no fiber bale is yet positioned, while maintaining a negative angle $\alpha$ of approximately 15°, the first fiber bale is, by means of the transfer belt 89 and while held by the supporting wall 88, shifted in the direction C onto the conveyor belt 14 which moves one cycle, that is, one fiber bale width (the fiber bale width is measured parallel to the travel direction of the conveyor belt 14). As soon as the supporting wall 88 has reached the conveyor belt 14, the latter, similarly to the transfer belt 89 is stopped and the spiked boards 85 are caused to penetrate the first fiber bale designated at 1*b* to maintain the latter in its inclined position. The subsequent one to five bales 1 are set up on the conveyor belt 14 in the same manner; in each instance the last-positioned fiber bale 1*b* is held by the spiked boards 85. After depositing 3 to 5 bales 1 with a negative angle $\alpha$, the subsequent bale 1, when the transfer carriage 81 has reached its end position in alignment with the conveyor belt 14 is, as the conveyor belt 14 is set into motion, caused to lean with a positive angle $\alpha$ against the already-deposited bales 1 as shown in FIG. 5*b*. The support wall 88 is then so inclined—while the conveyor belt 14 is still in motion—that the $\alpha$ angle becomes positive and after reaching the end position, that is, when the angle $\alpha$ has reached its positive value of approximately 15°, the transfer belt 89 is started and the bale 1*b* is transferred onto the running conveyor belt 14. Between the bale 1*b*' having a negative inclination and the bale 1*b* having a positive inclination, there is thus formed a wedge-like space 90 which is shown in an exaggerated manner in FIG. 5*b*. In practice, such a wedge-like space is much narrower, particularly because of the deformation of the bales in the upper (contacting) zone.

After the fiber bale 1*b* has assumed its position at the input end of the conveyor belt 14, it is held firmly in its position by the spiked boards 85 similarly to the previous fiber bale 1*b*'. The support wall 88 of the transfer carriage 81 travels backward and the subsequent transfer process may start. In each instance, the last-deposited fiber bale 1*b* on the conveyor belt 14 is held by the spiked boards 85 until there is reached a pressure compensation with the positive and negative angles $\alpha$.

The transfer process is repeated with the consecutive grasping of the last-deposited bale 1 with positive inclination by the spiked boards 85 until a pressure equalization is achieved. This occurs at a time when approximately the same number of bales 1 are inclined on the conveyor belt 14 with negative and positive inclination. In this manner a stability of the fiber bales 1 is achieved and thus a supporting of the fiber bales by the spiked boards 85 is no longer necessary.

Reverting to FIG. 1, the conveyor belt 14 includes a working zone situated between locations I and II in which fiber tuft removal from the bales 1 by the bale opener 12 takes place. A standby zone is situated between the locations II and III of the conveyor belt 14. On the conveying device 80 there is located a second standby zone between locations IV and V.

Figure 6:
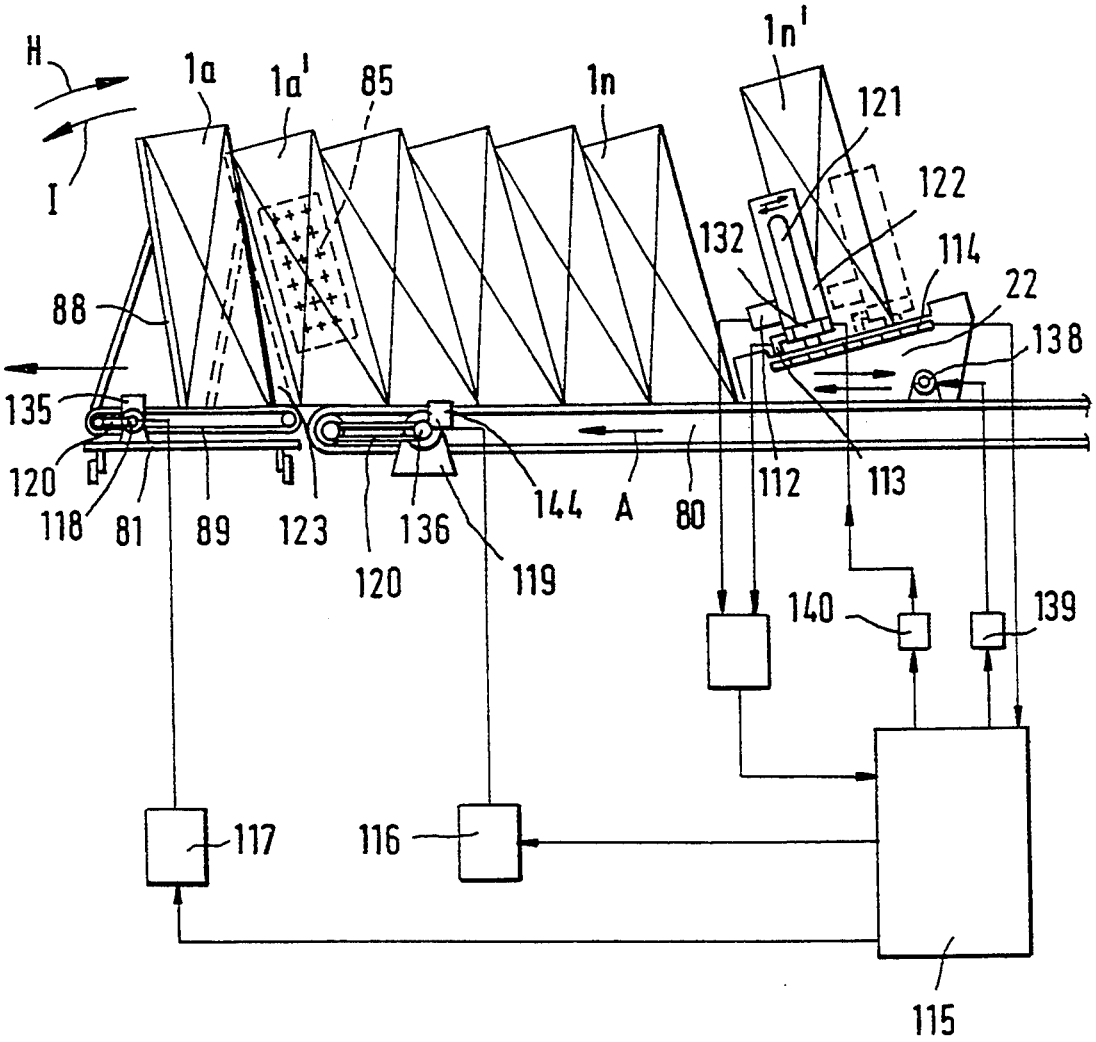
FIG. 6 is a schematic fragmentarily side elevational view of a conveying device and a bale transporting vehicle, together with a block diagram, including a path sensor, computer and feed control.

FIG. 6 depicts the moment when the bale transporting vehicle 22, together with the bale 1*n*' thereon, has moved along and above the conveying device 80 up to the last bale 1*n* deposited on the conveying device 80.

The bale transporting vehicle 22 which may move on rails (not illustrated in FIG. 6) above the conveying device 80 has two travelling pylons 122 which carry outwardly pivotal abutment gates 121. The bale 1*n*' situated on the transport carriage 22 leans against the abutment gates 121. A path sensor counter 113 mounted on one of the pylons is situated across the leading proximity switch 114 of the entire proximity switch row mounted on the carriage 22. Since the bale 1*n*' is firmly supported on the carriage 22 after it has been deposited thereon by a non-illustrated forklift and pressed against the abutment gates 121, the latter may be pivoted out of the way. The pylons 122 may move past the bale 1*n*' laterally in the rearward direction. Then the abutment gates 121 are again extended so that now they are in engagement with the trailing face of the bale 1*n*'. This condition is illustrated in phantom lines in FIG. 6. The sensor counter 113 has, during this occurrence, passed several proximity switches 114 and therefore triggered a corresponding number of pulses which are stored in the computer 115.

When now the pylons 122 move forwardly in the direction of the last fiber bale In situated on the conveying device 80, then the bale 1*n*' passes by the bale counter 112 whereby again a pulse is generated which is applied to the computer 115. From the two signals the computer 115 forms a data set whose value is sorted according to the ranking which the bale counter 112 has given to the respective bales.

Since not only the consecutive number (ranking) of a bale is stored in the memory 137 of the computer 115, but also the number of the bales 1 which were deposited and still dwelling on the conveying device 80, the computer 115 can determine which bale 1 is momentarily the leading bale 1*a*' on the conveying device 80 and can assign to such a bale the determined extent of feed via the conveying device control 116. The motor 119 driving the conveyor belt of the device 80 is thus cycled in such a manner that the bale 1*a*' is moved in the direction of the arrow A.

Before the above occurrence, however, the supporting wall 88 of the transfer carriage 81 is brought into its right hand position illustrated in phantom lines so that the supporting wall 88 lies against the bale 1*a*'. Thereafter the spiked boards 85 are withdrawn and in addition to the conveyor belt motor 119 the transfer belt motor 118 is set in motion as commanded by the transfer belt control 117. In this manner, the fiber bale 1*a*' reaches the position of the transfer carriage 81. The spiked boards 85 are pressed against the successive bale 1*a*'. At the same time, the transfer belt motor 118 continues to run until between the bales 1*a* and 1*a*' a gap 123 is formed and the bale 1*a* is thus no longer in contact with the bale 1*a*' situated on the conveying device 80.

Figure 7:
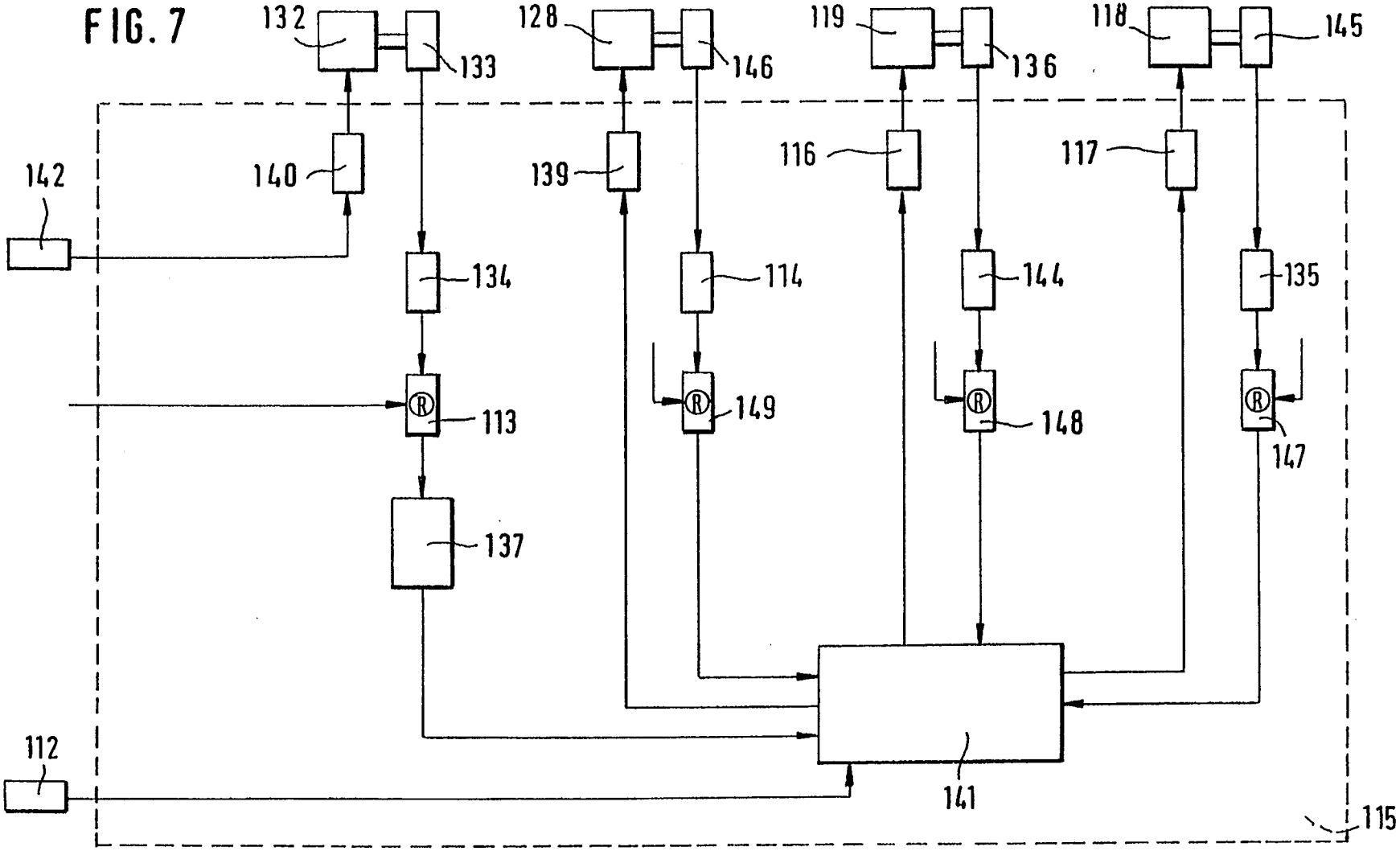
FIG. 7 is a block diagram for the control of the apparatus according to the invention.

FIG. 7 shows a basic block diagram of the circuitry for the transfer and separating stations. To the motor 132 which drives the pylon 122 there is applied a triggering pulse by the motor control 140 which, in turn, receives a signal from the pressure sensor 142 mounted on an abutment gate 121. A slotted disk 133 is mechanically connected with the motor 132. The slotted disk 133 serves as a damping member for the proximity switch 134 which applies its pulses to the counter 113. The counter 113 is connected to a resetting pulse conductor and is also connected with the memory 137. The latter transfers data to a comparator 141 which transmits the data to the control 116 of the motor 119 of the conveying device 80. The motor 119 is mechanically connected with the slotted disc 136 which functions as a damping member for the proximity switch 144 which is connected with a counter 112. The counter 112 too, is connected to a resetting conductor and is also connected to the comparator 141.

The slotted disk 145 operates in a similar manner. It is connected to the motor 118 of the transfer carriage 81 and is used as a damping member for the proximity switch 135 which is connected with the counter 147 and which too, is associated with a resetting conductor. The counter 147 applies its pulses to the comparator 141 with which the bale counter 112 is connected. In this manner, the entire system control may be centered in the computer 115.

Figure 8A:
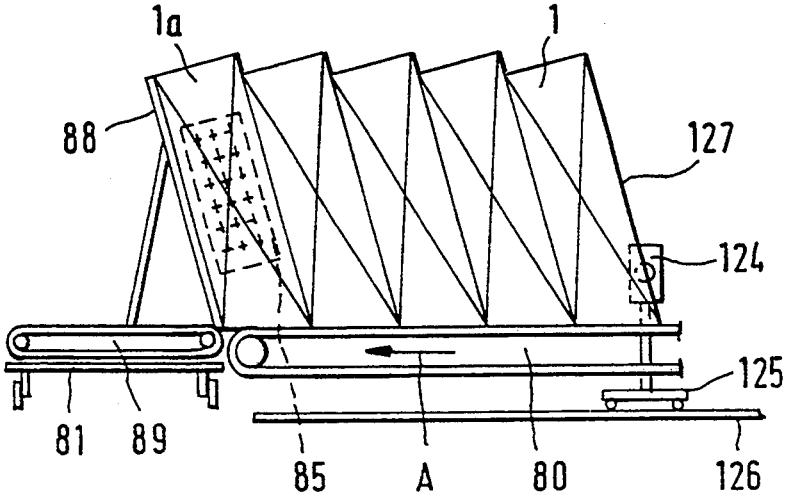
FIGS. 8*a* and 8*b* are schematic side elevational views of a travelling optical barrier according to the invention, showing two different operational positions.
Figure 8B:
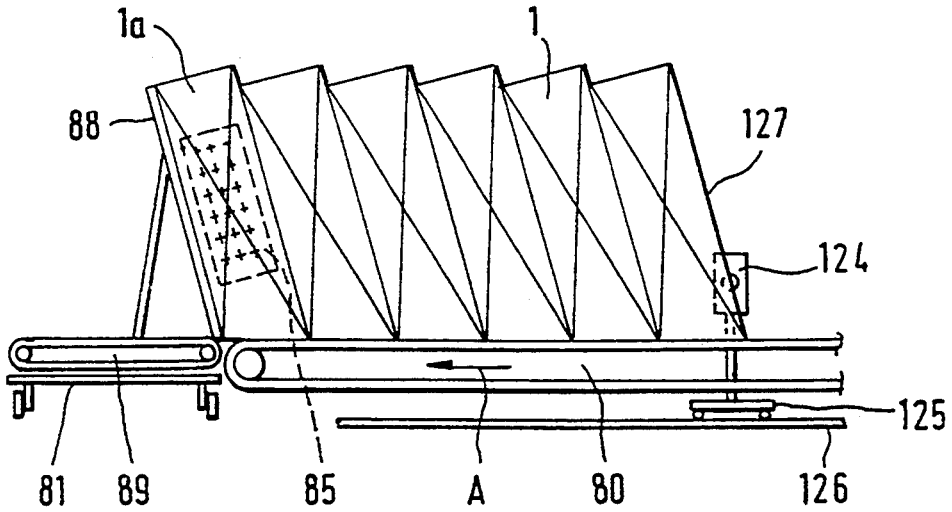

FIGS. 8*a* and 8*b* illustrate the operation of the travelling optical barrier 124. The latter is mounted on the carriage 125 which moves on a guide 126. In FIG. 8*a* there are five bales 1 on the conveying device 80. The carriage 125 travels from the right to the last (rightmost) bale 1 until it has detected the position of the trailing face (rear face) 127 of the last bale. A signal representing this position is applied to the computer 115. After depositing the consecutive bale, the carriage 125 first moves towards the right and therefrom towards the left until it has reached the trailing face of such consecutive bale and then again reports this position to the computer 115 so that from the difference the computer 115 may determine the width of such consecutive bale.

Figure 9A:
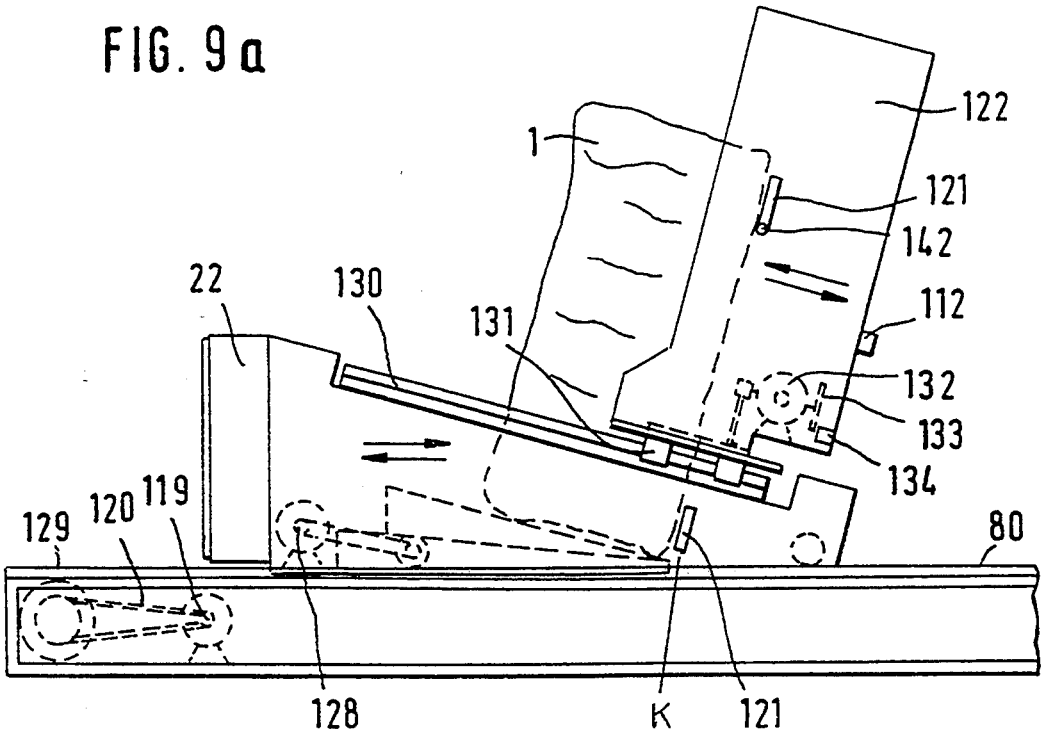
FIGS. 9*a*, 9*b*, 9*c* and 9*d* are schematic side elevational views illustrating different operational positions of a bale transporting carriage in the process of depositing a fiber bale on a bale conveying device.

FIGS. 9*a*, 9*b*, 9*c* and 9*d* illustrate the operation of the transporting (charging) carriage 22. FIG. 9*a* shows that one bale 1 has been positioned on the carriage 22 and the bale leans against the abutment gates 121 of the pylon 122 with its leading (frontal) face. The abutment gates 121 are coupled with the pressure sensor 142 which, when the bale 1 contacts the abutment gates 121, generates a pulse which is applied to the computer 115. The pylon 122 moves on rails 130 and is guided by a slide bearing 131. The pylon is driven by the motor 132 which applies pulses to the computer 115 via the slotted disk 132 in conjunction with the proximity switch 134. As shown in FIG. 9*a*, the pylon 122 is in the position K, that is, the fiber bale 1 lies with its frontal side against the abutment gates 121.

Figure 9B:
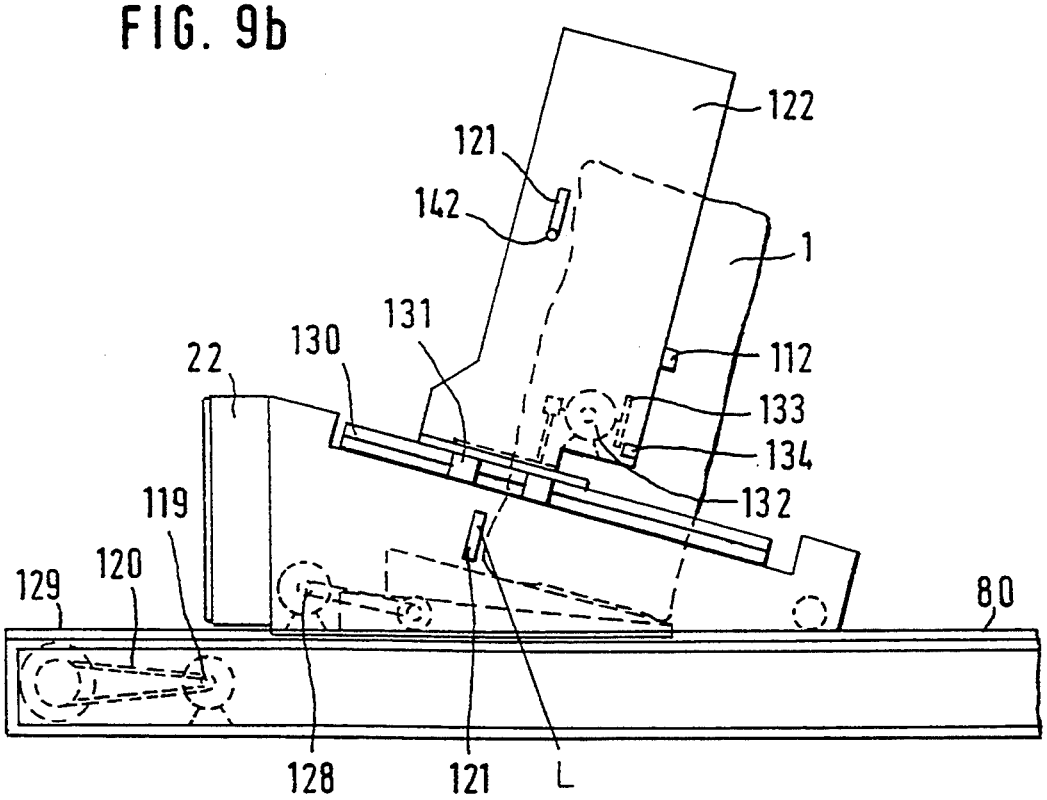
Figure 9C:
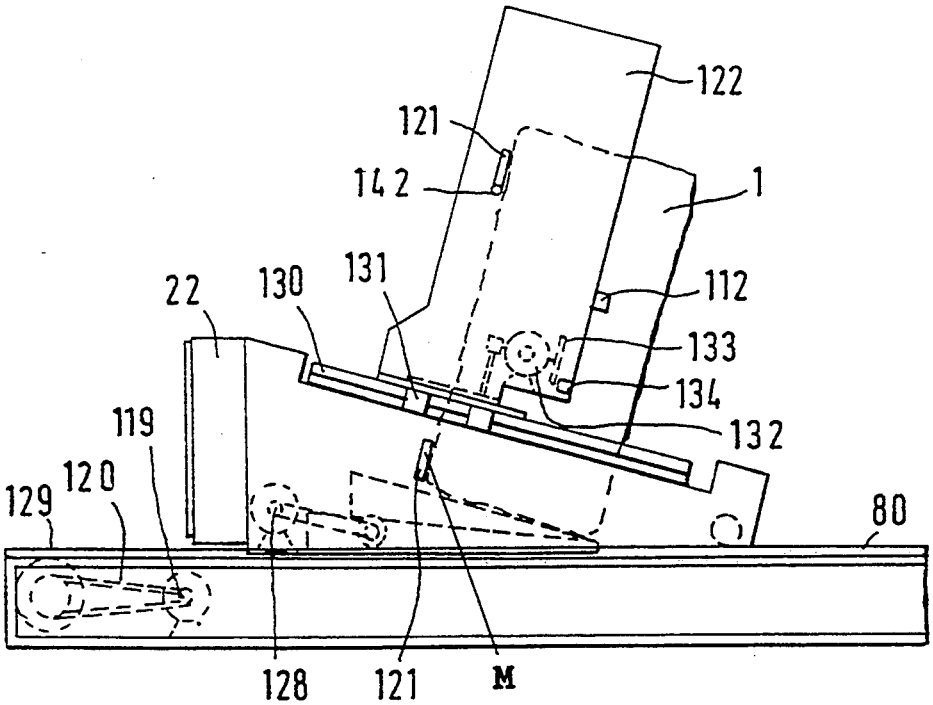
Figure 9D:
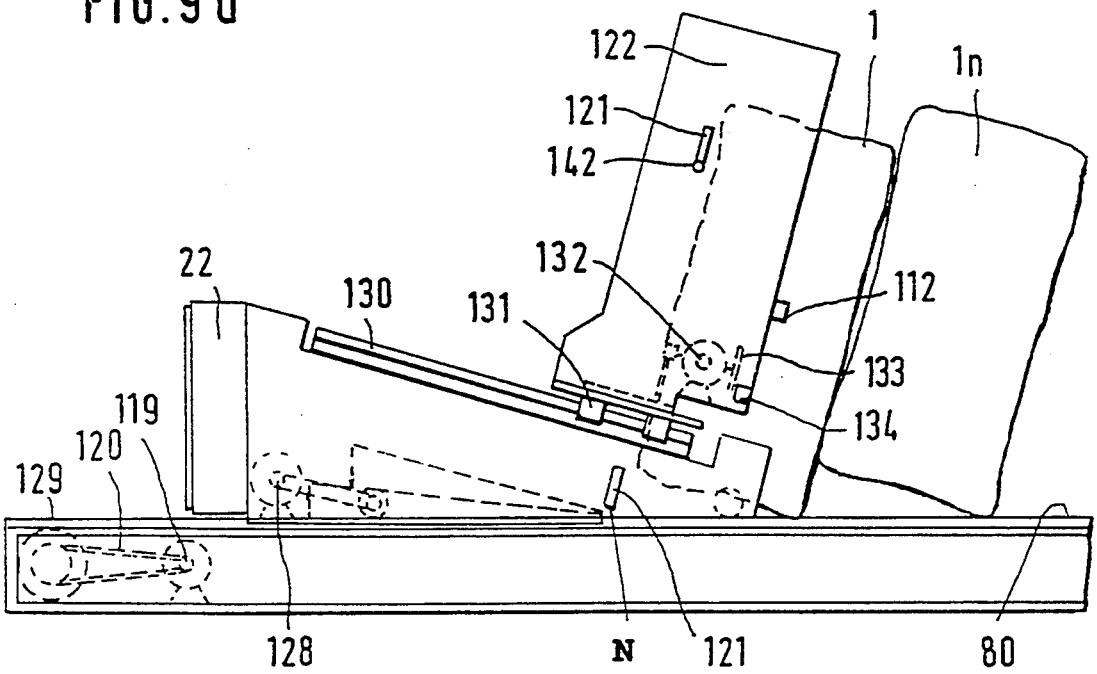

After the withdrawal of the abutment gates 121, the pylon 122 is moved past the fiber bales 1 to reach the position L illustrated in FIG. 9*b*. The abutment gates 121 are again pivoted inwardly whereby between the abutment gates 121 and the trailing face 127 of the fiber bale an air gap is obtained. The position L too, is applied to the computer 115. Thereafter, the pylon 122 again travels to the right until the abutment gates 121 lie on the trailing side 127 of the bale 1 and thus the pressure sensor 142 generates a pulse. This position is illustrated in FIG. 9*c* where the pylon 122 has reached the position M. The abutment gates 121 engage the trailing face 127 of the fiber bale 1. Upon further motion of the pylon 122, the bale 1 is pressed against the fiber bale last deposited on the conveying device 80, as illustrated in FIG. 9*d*. At this time, the pylon 122 reaches the position N whereupon a pulse is generated which is applied to the computer 115 which, by forming a difference between the magnitudes of the signals determines the width of the bale 1.

Thereafter, the computer 115 sends further orders to the charging carriage 22 which, driven by motor 128, moves on the rails 129 above the conveying device 80 (constituted by a conveyor belt). The conveying device 80 also receives commands from the computer 115 which start the motor 119, driving the conveyor belt of the conveying device 80 via a drive belt 120.

It is to be understood that it is feasible to provide, in a non-illustrated manner, two or more conveyor belts 80 serving the bale transfer station 87. It is also feasible to connect the conveyor belts 80 to the bale transfer station 87 on the side remote from the conveyor belt 14.

It will be understood that the above description of the present invention is susceptible to various modifications, changes and adaptations, and the same are intended to be comprehended within the meaning and range of equivalents of the appended claims.

What is claimed is:

1. A method of arranging fiber bales to form a first, operational bale row in preparation for detaching fiber tufts from the bales of the first row by a bale opener; comprising the followings steps:

(a) consecutively carrying fiber bales by a transporting device along a conveying device to form a second, standby row of fiber bales on said conveying device by consecutively depositing fiber bales on said conveying device next to a momentarily trailing bale of said second row such that a width of the fiber bales on the conveying device extends parallel to an advancing direction of the conveying device;

(b) moving said conveying device in said advancing direction for consecutively advancing the bales of said second row to a bale separating station situated at an output end of said conveying device;

(c) separating a momentarily leading bale of said second row from remaining bales of said second row;

(d) transferring the fiber bales from said conveying device to a location where said first row of bales is formed in an operating zone of the bale opener;

(e) determining the width of each fiber bale while on one of said transporting device and said conveying device;

(f) determining the ranking of each fiber bale while on one of said transporting device and said conveying device;

(g) generating signals representing said width and ranking;

(h) storing said signals in a memory; and (i) based on said signals, determining an extent of feed for each said bale for the separating step.

2. The method as defined in claim 1, wherein said moving and separating are performed in intermittent steps; the length of the separating steps are by a selectable magnitude greater than the length of the moving steps.

3. The method as defined in claim 1, wherein step (e) is performed for a bale during loading thereof on said conveying device.

4. The method as defined in claim 1, wherein step (e) comprises the steps of generating, by an optical sensor, a starting signal representing a position of a vertical trailing edge of a fiber bale last-deposited on said conveying device; moving the optical sensor from said vertical trailing edge to a vertical trailing edge of a fiber bale newly-deposited on said conveying device next to the last-deposited fiber bale; and generating, by the optical sensor, an end signal representing a position of said vertical trailing edge of the newly-deposited fiber bale.

5. The method as defined in claim 4, wherein step (e) includes the step of utilizing the end signal associated with a last-deposited fiber bale as the starting signal for a newly-deposited fiber bale.

6. The method as defined in claim 1, wherein step (f) is performed for a bale during loading thereof on said conveying device.

7. The method as defined in claim 1, wherein step (f) is performed for a bale during loading thereof on said transporting device.

8. The method as defined in claim 1, further comprising the step of stabilizing the bales on the conveying device by a supporting device.

9. An apparatus for arranging fiber bales to form a first, operational bale row in preparation for detaching fiber tufts from the bales of the first row by a bale opener, the apparatus comprising (a) a conveying device for receiving fiber bales thereon in a second, standby row; said conveying device having an output end;

(b) a drive for moving said conveying device to advance the bales thereon toward said output end;

(c) a transporting device for consecutively carrying fiber bales along said conveying device for forming said second row of fiber bales on said conveying device by consecutively depositing fiber bales on said conveying device next to a momentarily trailing bale of said second row such that a width of the fiber bales on the conveying device extends parallel to an advancing direction of the conveying device;

(d) a transfer device for separating a momentarily leading fiber bale of said second row at said output end of said conveying device from the fiber bales remaining on said conveying device and for transferring the separated fiber bale from said output end to a location receiving the fiber bales of said first bale row;

(e) means for determining the width of each fiber bale while on one of said transporting device and said conveying device;

(f) means for determining the ranking of each fiber bale while on one of said transporting device and said conveying device;

(g) means for generating signals representing said width and ranking;

(h) memory means for storing said signals; and (i) means for determining, based on said signals, an extent of feed for each said bale from said conveying device to said transfer device.

10. The apparatus as defined in claim 9, further comprising a supporting device for stabilizing the bales on the conveying device.

11. The apparatus as defined in claim 9, wherein said means for determining the width comprises a displacement sensor.

12. The apparatus as defined in claim 9, wherein said means for determining the width comprises a displacement sensor; said displacement sensor including a counter and a row of proximity switches operatively connected with said counter.

13. The apparatus as defined in claim 9, wherein said means for determining the ranking comprises a counter.

14. The apparatus as defined in claim 9, wherein said means for determining the extent of feed comprises a computer connected to said means for generating said signals.

15. The apparatus as defined in claim 14, further comprising a drive for moving said transfer device; said computer being connected to said drive of said conveying device and said drive of said transfer device for applying control signals thereto, representing said extent of feed.

16. The apparatus as defined in claim 9, wherein said means for determining the width comprises a displacement sensor; said displacement sensor including an incremental rotary position sensor.

17. The apparatus as defined in claim 9, wherein said transporting device includes an abutment gate for engaging a vertical end face of the bale situated on the transporting device; said means for determining the width comprising a pressure sensor mounted on said abutment gate and being actuatable by the vertical end face of the bale.

18. The apparatus as defined in claim 9, wherein said means for determining the width comprises an optical assembly.

19. The apparatus as defined in claim 18, wherein said optical assembly comprises an optical barrier and means for displacing said optical barrier along and relative to said conveying device.

20. The apparatus as defined in claim 19, wherein said optical barrier includes a row of light emitting diodes and a row of photodiodes; said row of light emitting diodes and said row of photodiodes cooperating with, and being displaceable relative to one another for generating a signal representing a relative position therebetween.

21. The apparatus as defined in claim 20, wherein one of the diode rows is affixed to said transporting device; further comprising a pylon mounted on and movable relative to said transporting device; further wherein another of the diode rows is affixed to said pylon.

* * * * *